US005288322A

United States Patent [19]

Hanna et al.

[11] Patent Number: 5,288,322

[45] Date of Patent: Feb. 22, 1994

[54] APPARATUS AND METHOD FOR COLORING TEXTILE ARTICLES WHILE EXPANDED AND PRESSED AGAINST A PATTERN

[75] Inventors: Ashley R. Hanna, Christchurch; Philip D. Buckman; Graeme K. Crossman, both of Timaru, all of New Zealand

[73] Assignee: Annett & Darling Limited, Timaru, New Zealand

[21] Appl. No.: 953,670

[22] Filed: Oct. 1, 1992

[30] Foreign Application Priority Data

Oct. 2, 1991 [NZ] New Zealand ..... 239625
Oct. 3, 1991 [NZ] New Zealand ..... 240078
Nov. 27, 1991 [NZ] New Zealand ..... 240770

[51] Int. Cl.[5] ..... B05C 5/00; B05D 3/12

[52] U.S. Cl. ..... 118/33; 118/213; 118/301; 118/313; 118/321; 118/406; 118/500; 118/504; 427/171; 427/282; 427/288; 8/148; 8/150; 68/202; 68/205 R; 101/35; 101/483

[58] Field of Search ..... 427/171, 282, 288; 118/33, 213, 301, 313, 320, 321, 406, 504, 500; 8/148, 149, 150, 154; 68/202, 205 R, 235 R; 101/35, 483

[56] References Cited

U.S. PATENT DOCUMENTS 2,019,156 10/1935 Mueller et al. ..... 101/126
4,745,863 5/1988 Takezaki ..... 101/35

FOREIGN PATENT DOCUMENTS 2171644 9/1986 United Kingdom ..... 101/35

*Primary Examiner*—Terry J. Owens
*Attorney, Agent, or Firm*—Lowe, Price, LeBlanc & Becker

[57] ABSTRACT

A process for applying a pattern in a contrasting color to textile articles such as socks consists of entering the textile article onto an expandable article support (29), bringing a perforated pattern (38) over the article on the support, causing the support (29) to expand to press the textile article against the interior of the pattern (38), and applying typically by spraying a coloring agent onto the article through the pattern. The support (29) is subsequently contracted and the pattern (38) and then the textile article which a corresponding design has been printed, removed. Apparatus for applying a single color or multicolor pattern to articles such as socks has a carousel (23) carrying a multiple number of article supports (29). The carousel (23) rotates with a stepped movement between printing stations (54). In each operation, a spray frame (44) carrying the printing stations (54) is raised upwardly over the article supports (29) and patterns (38) disposed thereon to spray dye onto the textile articles through the patterns (38). Alternatively, the dye may be applied to the textile articles by dipping the whole assembly of expanded support, textile article and pattern into a bath of dye, by rollers passing over the exterior of the pattern, or by bristles. Four printing stations may be provided in a four color machine.

15 Claims, 12 Drawing Sheets

APPARATUS AND METHOD FOR COLORING TEXTILE ARTICLES WHILE EXPANDED AND PRESSED AGAINST A PATTERN

TECHNICAL FIELD

The invention relates to apparatus and a method for applying pattern in contrasting colors to textile articles such as made up and semi-made up garments and materials, including socks and items of hosiery in particular.

BACKGROUND OF INVENTION

A coloured pattern may be produced in a textile article by weaving or knitting the textile with different coloured yarns in a garment formed of a woven or knitted textile material. Alternatively a garment may be made up of panels of differently coloured fabrics stitched together, or a logo or design may be sewn or adhered onto the garment. A pattern or design may also be applied to a garment by printing using dyes or inks or the like.

The most commonly-used process for printing made-up garments is screen-printing. However, screen-printing requires the article to be printed be laid flat. Batik printing also can be used to print made-up garments, but also requires that the article to be printed be laid flat. Textile articles which cannot be laid flat such as socks and hosiery are difficult to pattern or colour by printing after they have been made up, patterns or a logo or design are generally introduced by weaving or knitting into the textile material raw stock.

U.S. Pat. No. 2,019,156 describes an apparatus for printing a pattern about the top of a hosiery item comprising a rigid form over which the top of the hosiery item is entered. The rest of the length of the hosiery item is received within a dished portion of the top of the form. A two part stencil is then disposed about the form. Dye is sprayed onto the hosiery item through the stencil. Blotting paper is used about the form beneath the hosiery item to absorb surplus paint.

U.S. Pat. No. 4,745,863 described apparatus for printing a hosiery article comprising a four-part foldable underplate in the form of a polygonal tube. The underplate is inserted into the tubular fabric item and is then folded flat in one configuration. The front side and then the back side of the hosiery item on the underplate are printed. The underplate is then folded to its other configuration and different portions of the hosiery item are printed. The foldable underplate is then removed from the hosiery item.

It is the object of the present invention to provide an improved or alternative process for printing textile articles after making up or at least partial making up, an apparatus for automated printing of such textile articles.

SUMMARY OF INVENTION

The present invention provides a process for applying a pattern in a contrasting color to textile articles, comprising entering a textile article onto an article support, bringing a pattern provided with one or more apertures defining the design to be applied in overlying relationship about the article on the support, causing the article support to expand to press the textile article tightly against the interior of the pattern, applying a coloring agent to the article through the pattern, and subsequently contracting the article support and removing the pattern and article.

The invention also provides apparatus for patterning textile articles, comprising an article support of a shape whereby a textile article to be printed may be entered over the support, a pattern and means for bringing the pattern into overlying relationship about the article on the support, and means for causing the support to expand to press the article tightly against the pattern within the pattern, and means for applying a color agent to the article through the pattern.

The invention also provides apparatus for applying a pattern in contrasting color to textile articles, comprising conveyor means carrying a multiple number of generally cylindrical article supports of a complementary shape for each receiving a textile article over the article supports, a multiple number of printing stations each comprising a generally tubular pattern and means to apply the coloring agent onto a textile article through the pattern with the conveyor means arranged to move the article supports to and from the printing stations, means movably mounting the pattern or the article support for movement relative to one another to enter the article support and a textile article thereon into the pattern for printing and to remove the article support and textile article from the pattern after printing, and means to cause each article support to expand when at said printing station to press the article against the pattern sufficiently to hold the pattern over the textile article during printing.

Preferably at each printing station the pattern is movably mounted for entering the article support and textile article thereon into the pattern by moving the pattern over the article support for printing and for removing the pattern from the article support after printing, and scavenging means to scavenge excess coloring agent remaining on the pattern prior to printing of a subsequent textile article.

In an apparatus of the invention with a multiple number of printing stations each printing station may provide a different pattern and/or color to the article so that an article is printed at each of a number of stations in turn to give a multicolored article. In another apparatus with a multiple number of printing stations the apparatus may be arranged to print a number of articles simultaneously each with one color at a single station. For example, a six station machine may be arranged to print six textile articles simultaneously, with a single color.

A multiple printing station apparatus whether multicolour or single color may comprise a rotary machine utilising a rotary stepped action to convey each article over the series of printing stations. A number of rotary machines may be ganged together to increase printing capacity. In another form of multiple printing station machine one or more continuous conveyors may be employed to carry the articles through each of the series of printing stations. Various arrangements are possible.

The article support may be expanded to press the article to be printed against the pattern by being inflated from within. Alternatively the article support may be expanded by mechanical means such as expanding arms within the article support, for example.

In this specification "textile" is intended to refer not only to woven and knitted but also to non-woven fabrics including piled fabrics whether made up into completed articles such as garments or not.

By "coloring agent" is meant fabric dyestuffs, inks, paints, latexes or any other coloring agent or the like desired to be employed.

DESCRIPTION OF DRAWINGS

The invention will be further described by way of example only with reference to the accompanying drawings, in which.

DETAILED DESCRIPTION OF THE PREFERRED EMBODIMENTS

Principle of Invention

Figure 1:
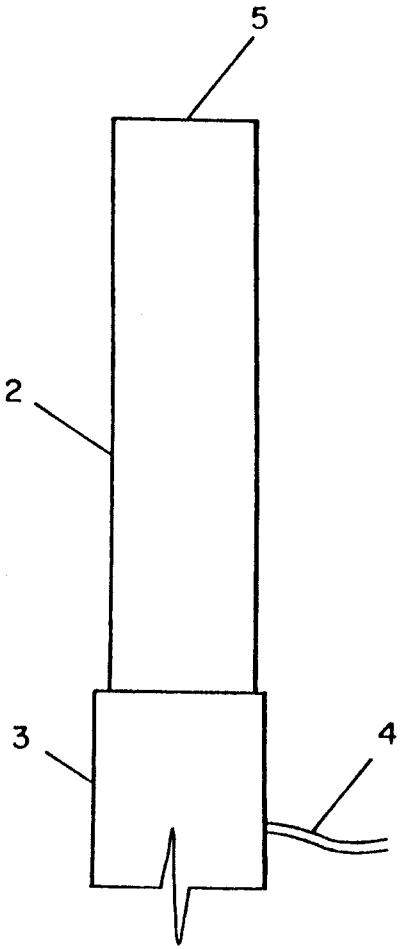

The principle of the invention is described with reference to FIGS. 1 and 2 of the drawings and the printing of hosiery such as socks or stockings. An expandable article support 2 is for example mounted upon a base 3. The article support 2 is generally cylindrical (which includes oval for example) and the exterior of the article support is composed of a tough, resiliently expandable material such as rubber, a rubber-like synthetic material, fibreglass or any like tough resiliently expandable material which can expand and contract with the article support. Another suitable material is a woven material such as a synthetic material, the weave or which will allow it to expand.

The diameter of the support 2 is such that in use a sock or stocking may be stretched over the support without difficulty. The article support 2 is then expanded in diameter. The article support may be inflatable by pneumatic or hydraulic fluid, admitted through a hose 4 connected into the base 3. The article support may alternatively be inflatable by steam, which will have the effect of heating the article support to assist with some dye stuffs or coloring agents of fixing the dye as will be referred to further. Alternatively again the article support may be expanded by way of a mechanism within the article support for pressing the side walls outwardly, such as a scissors mechanism acting between the side walls of the article support, operated by an electrical solenoid for example.

A generally cylindrical pattern 7 (see FIG. 2) has a diameter such that the pattern is a sliding fit over the sock 6 on the support 2. The pattern may be rigid or flexible. A typical rigid pattern would be made of aluminium or stainless steel, having one or more apertures through the pattern defining the pattern to be printed on the sock. The pattern 7 may have many apertures e.g. the pattern may be made of mesh; alternatively the pattern may provide only a single aperture, in the shape of the required logo, picture or other design. A typical flexible pattern may be made of tough plastics material, e.g., nylon net.

A sock 6 to be printed (which may be plain white or already dyed some other colour) is put over the article support 2, and is pulled down until the toe of the sock is firmly over the end 5 of the support. The pattern 7 is then placed over the sock. The article support 2 is caused to expand as indicated by the double-headed arrows D in FIG. 2, to press the sock tightly against the inner surface of the pattern 7. For woollen socks, a pressure in the range 10 to 20 and particularly about 15 pounds per square inch has been found satisfactory.

Figure 2:
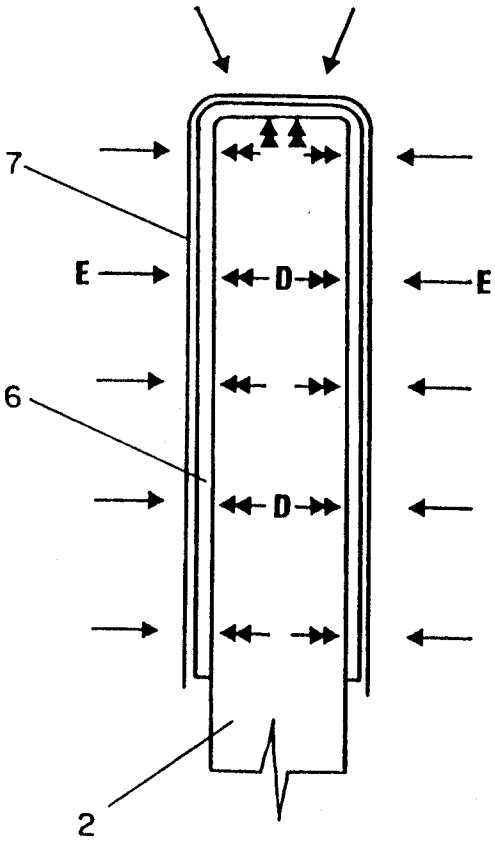
FIGS. 1 and 2 schematically illustrate the principle of the invention.

Dye is then applied to the sock, either by dipping the whole assembly of inflated support, sock and pattern into a bath of dye, by rollers passing over the exterior of the pattern, by bristles, by spraying, or by any other suitable means, and most preferably by spraying dye onto the assembly as indicated by arrows B in FIG. 2. Since dye can pass only through the apertures in the pattern, the shape of the or each aperture is printed onto the sock. The pressure between the article support and the pattern prevents the dye from running and blurring the printed pattern applied to the sock, and the dye penetration into the article being dyed is excellent.

The pressure between the article support and the pattern needed to prevent the dye from running may vary, depending upon the type of dye used or the type of textile. After the dye has been applied, the article support 2 is contracted to its normal condition, and the pattern and printed sock are then removed. The process may then be repeated with one or more further patterns on the same article to achieve a more complex and/or multi-coloured design.

After removal, the printed sock is then finished in the manner appropriate to the dye used. For example, if a cold-water dye is used, the sock is heated for a few minutes in a microwave or a conventional oven, to assist in setting the dye, and is then rinsed in a weak detergent solution to remove any surplus dye, and dried.

Most preferably the article support is caused to expand sufficiently to stretch open the weave or knit of the sock in pressing the article against the pattern. Good penetration of the coloring agent or dye into the weave or knit of the article and good pattern definition is achieved, so that when a sock for example is slightly stretched when worn, the printed pattern will still be clear.

As well as printing hosiery items such as socks, other generally tubular textile articles may be printed such as scarves, for example, which are sometimes knitted in tubular form, or alternatively parts of articles such as the legs of trousers or arms of shirts or sweaters, or the body part of a shirt or sweater.

DESCRIPTION OF THE PREFERRED EMBODIMENT PER FIGS. 3 TO 12

A preferred form of apparatus of the invention shown in FIGS. 3 to 12 comprises a series of four printing stations for simultaneously printing four items of hosiery and in particular socks, and a loading station and unloading station. The apparatus has a rotary stepping operation. A sock is loaded onto an article support at the loading station and is sequentially stepped through each of the printing stations. At each printing station a different pattern and/or colour is applied to the sock, to provide a four coloured/patterned sock.

Figure 5:
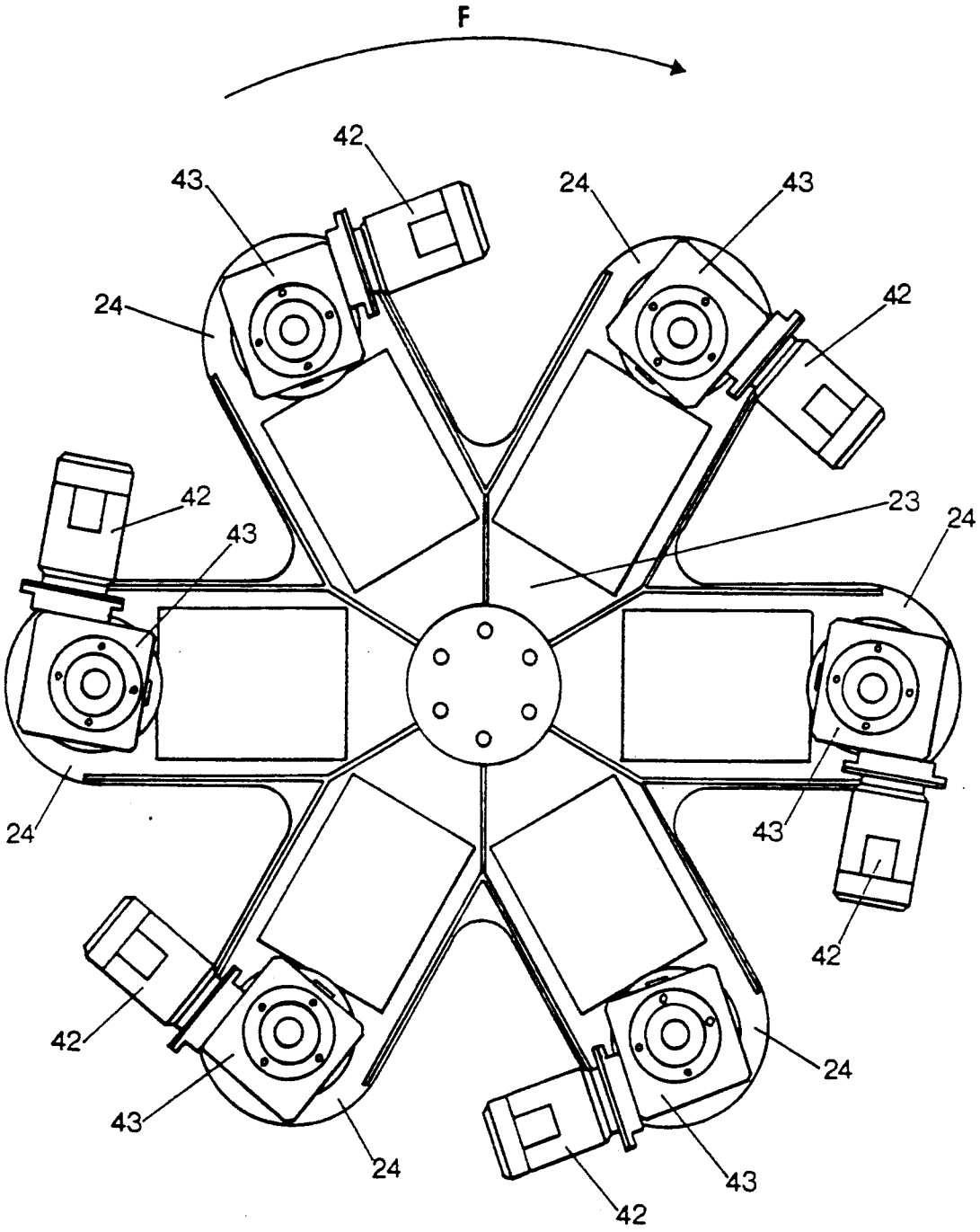
FIG. 5 shows the preferred form of the apparatus from above.

The preferred form apparatus comprises a fixed base frame consisting of a bed 20, four uprights 21, and cross-members 21. The base frame carries a rotating carousel 23. The carousel 23 in the preferred form apparatus shown in the drawings consists of a flat spider plate with six arms 24 as best seen in FIG. 5, with strengthening ribs 25. The carousel 23 is rotatably mounted to the base frame by a shaft extending downwardly from the centre of the carousel 23 which is journalled in the base frame by main bearing 26—see FIGS. 3 and 6. In operation of the machine the carousel rotates in the direction of arrow F in FIG. 5. The carousel 23 forms conveyor means of the apparatus. The carousel is driven by a motor 27 through a drive gear 27*a* (see FIG. 6) and a ring gear 28 fixed to the underside of the carousel 23.

Each of the six radially extending arms 24 of the carousel carries an expandable article support 29. Each of the article supports 29 is generally cylindrical as shown, in a shape complementary to socks to be printed. One of the article supports is shown in cross-section in FIG. 7. Each article support comprises a cylindrical body formed by a tube 30 of stainless steel or other suitable material for example. A top member 31 is fitted to one end of the tube and a bottom member 32 to the other end of the tube. The main body of the article support has a tubular covering 33 of a silicon rubber or other similar expandable material as referred to previously. At the bottom of the article support the covering 33 is clamped to the article support and particularly to the bottom member 32 by end cap 34 which is held in position by screws 35 passing into the bottom member 32. At the top of the article support ring 35 clamps the top of the covering 33 in position and is secured by screws 36 passing into the circumferential flange 37 of the top member 31.

Figure 7:
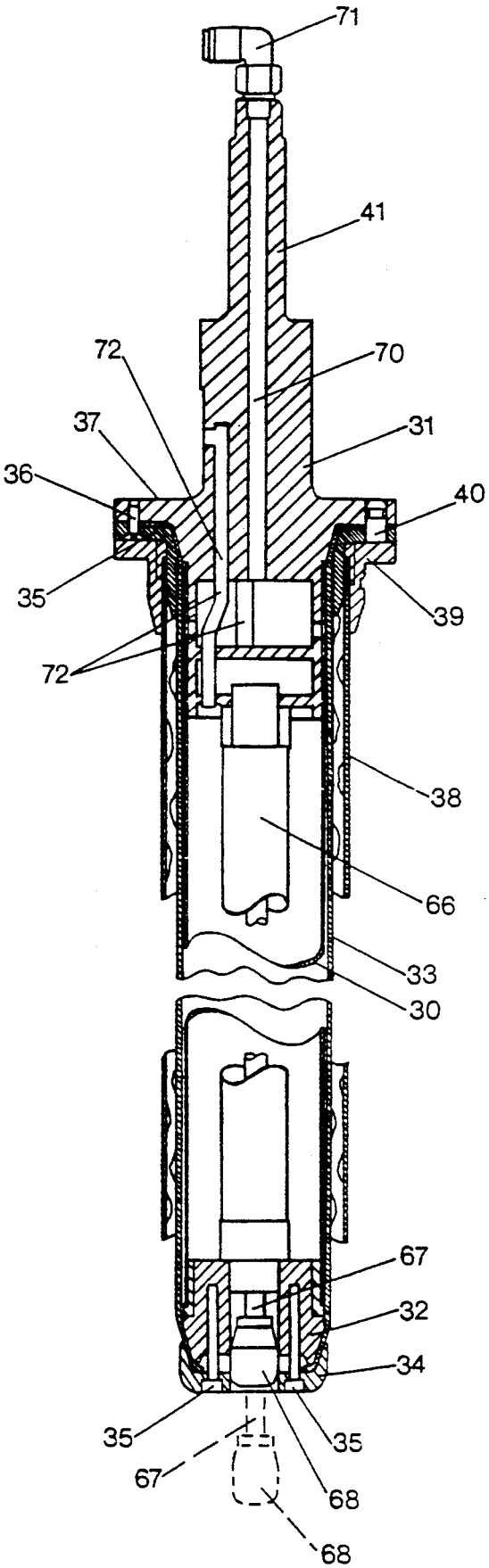
FIG. 7 is a cross-sectional view through one article support of the preferred form of the apparatus.
Figure 8:
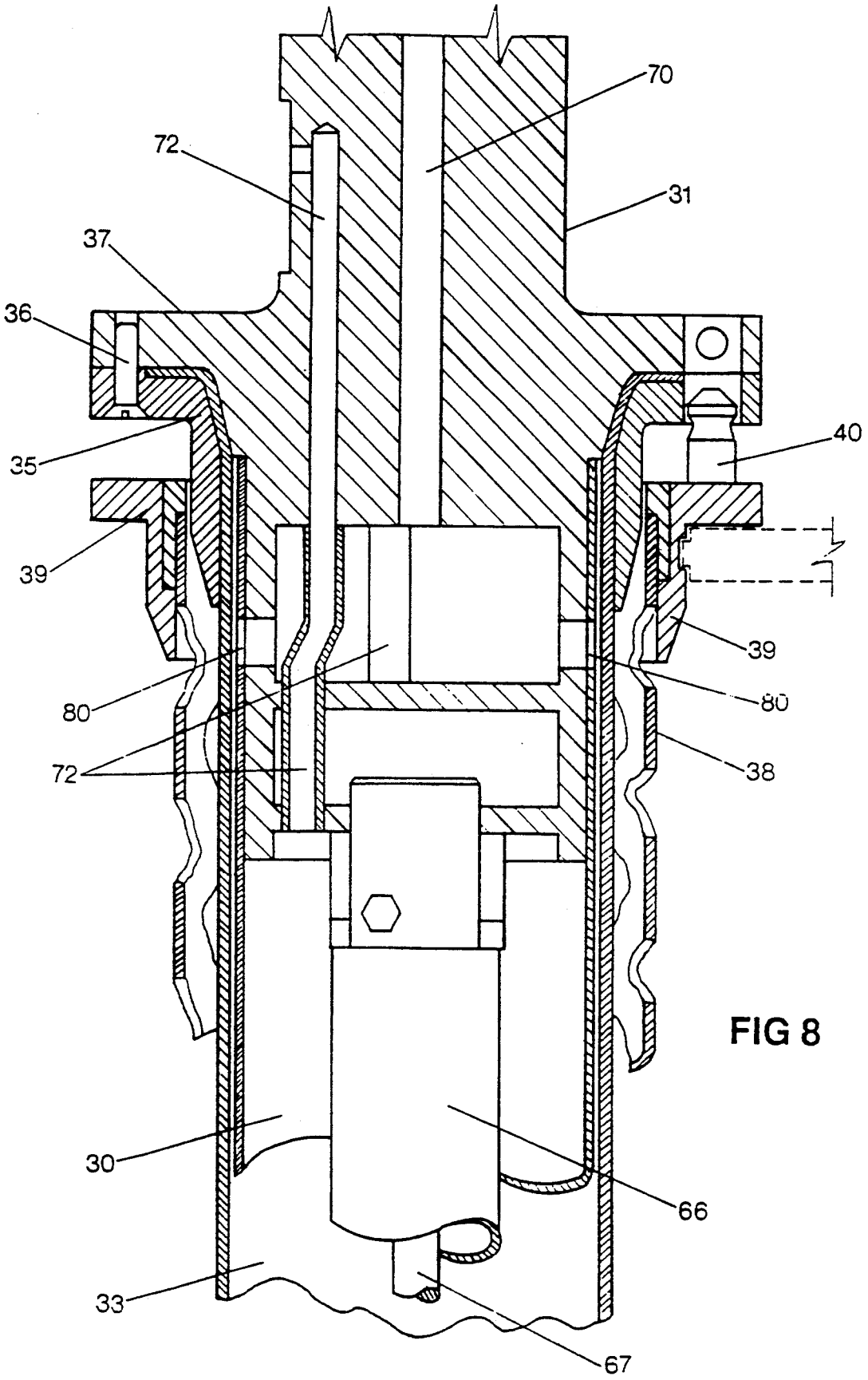
FIG. 8 is a cross-sectional view similar to FIG. 7 but through an upper part only, of an article support of the preferred form of the apparatus.
Figure 9:
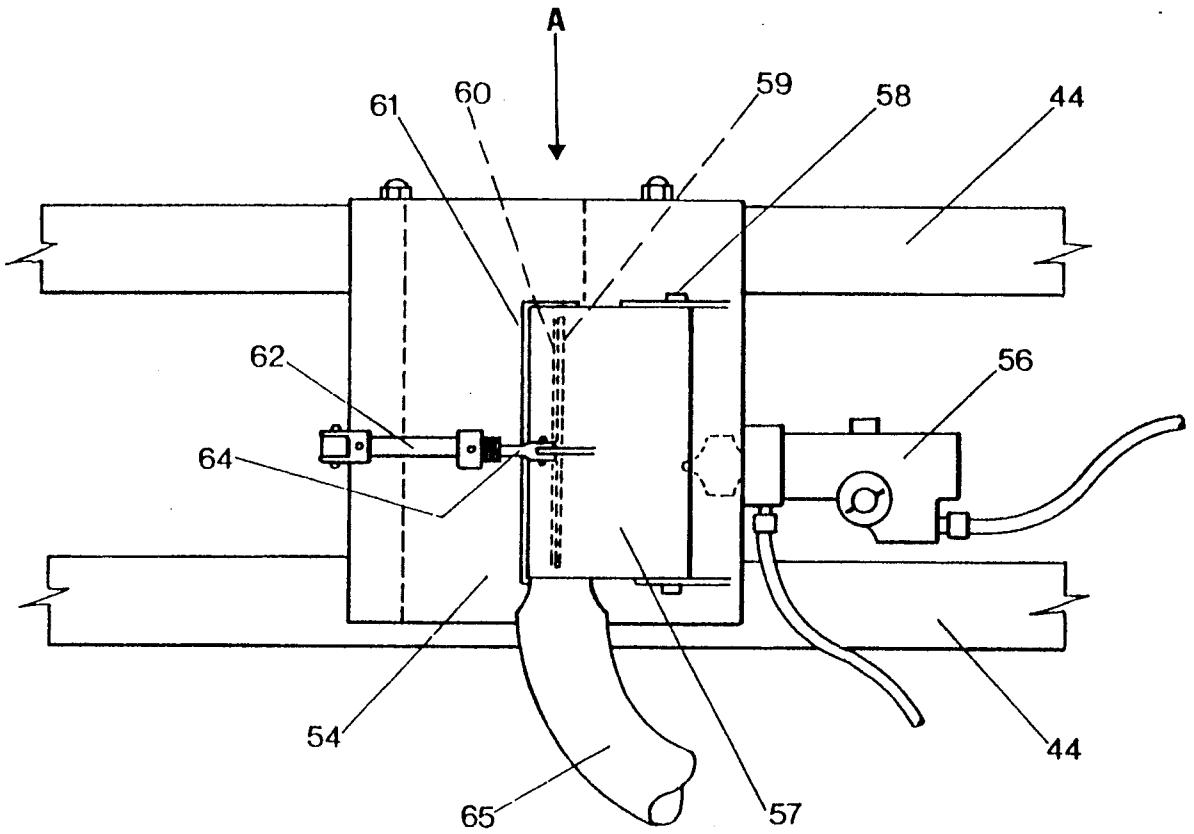
FIG. 9 is a side view of a spraying and scavenging chamber of the preferred form of the apparatus.
Figure 10:
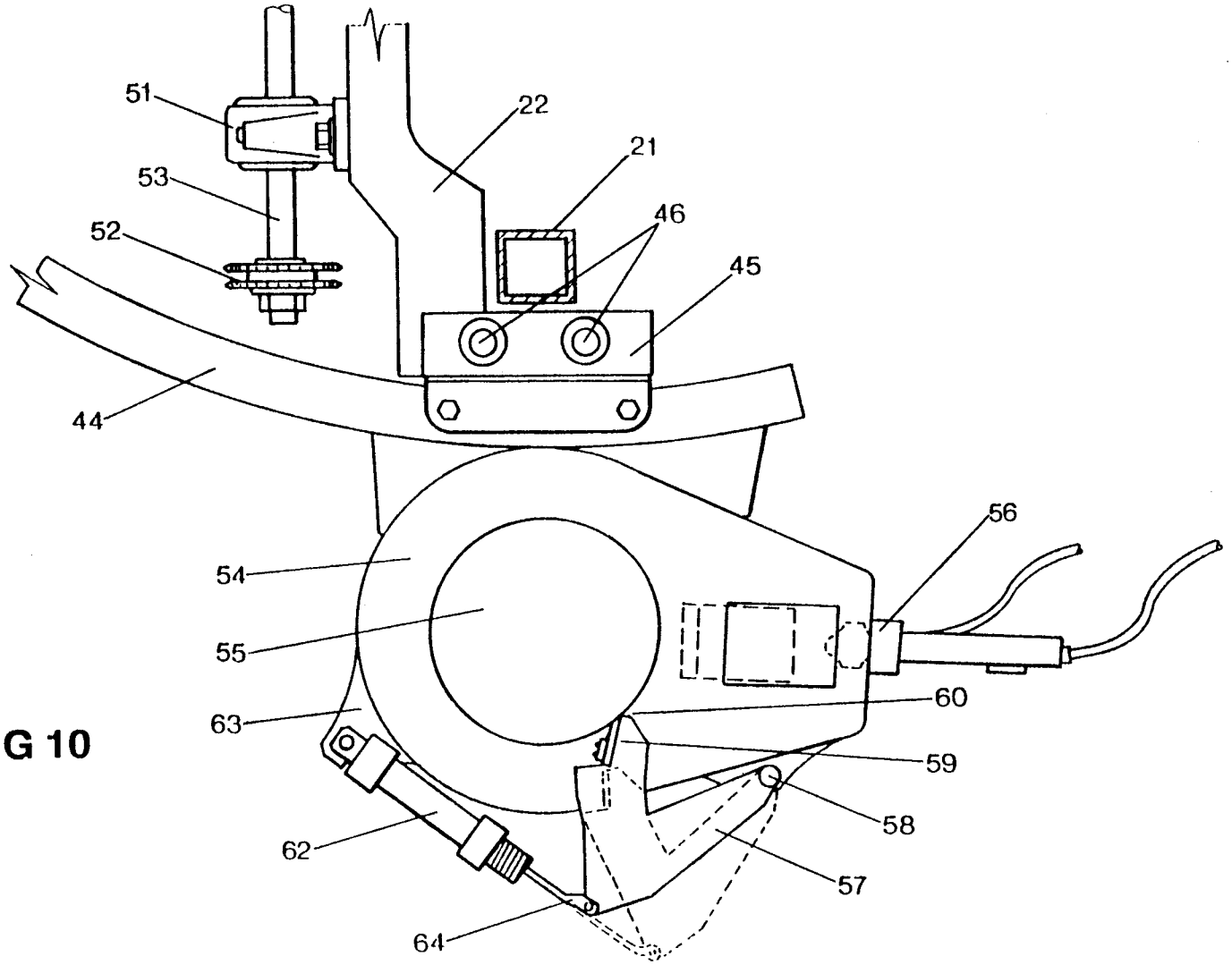
FIG. 10 is a view from above, a scavenging and spraying chamber of the preferred form of the apparatus, in the direction of arrow A in FIG. 9.

A pattern 38 is also shown in FIG. 7. The pattern shown comprises a cylindrical tube formed of stainless steel for example, perforated with the desired pattern, which fits over the article support 29 with a space between to in use accommodate a sock on the article support, so that in operation of the machine the pattern 38 can easily slide upwardly onto the article support 29 and over a sock on the article support before the article support is expanded as will be described. The pattern has fixed to its top a pattern ring 39 which, when the pattern is in position on the article support 29, fits against the ring member 35 fixed to the article support top flange 37. A locating pin 40 extends upwardly from the pattern ring 39 on one side, and passes into a bore through the ring member 35 and article support top member 31 when the pattern is fully home on the article support, to positively locate the pattern on the article support. In FIG. 8 a pattern 38 is shown immediately before pushing of the pattern fully home on the article support. Spring-biased balls (not shown) engage the top of the pattern pin 40 to hold the pattern in position during printing of a sock on the article support 29, until it is removed after printing as will be described.

The top member 31 of the article support has a shaft part 41. At the end of each carousel arm 24 is carried a drive motor 42 with gear box 43. Each article support 29 is carried by the carousel, by the shaft part 41 of the article support top member passing through an aperture in the end of a carousel arm 24 and being coupled to the gear box 43. When the motor 42 is driven, the article support will rotate about its longitudinal axis, as shown by arrow G in FIG. 3.

Figure 3:
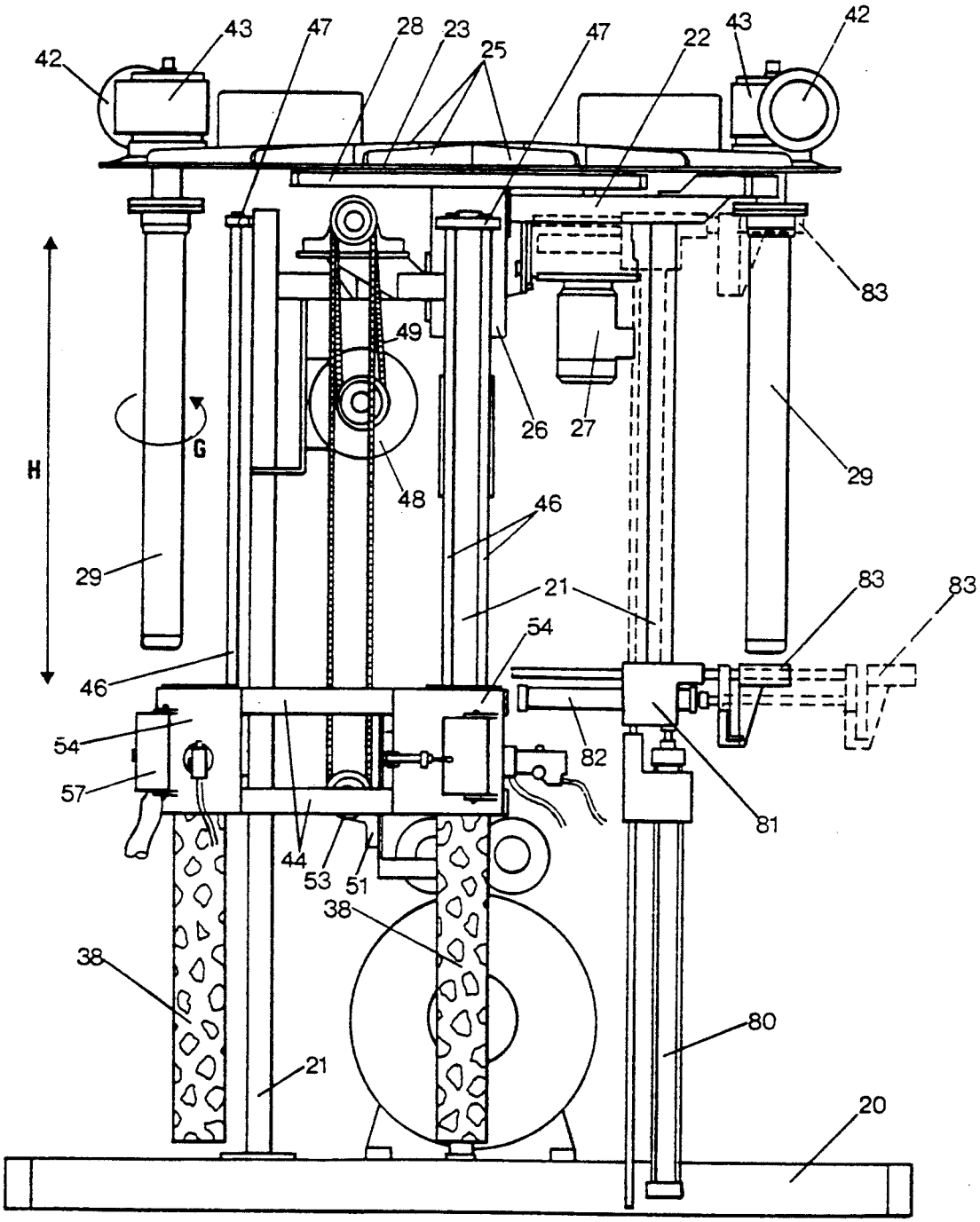
FIG. 3 shows one preferred form apparatus in side view, not during a printing operation, showing one position of the loading station in phantom outline.
Figure 4:
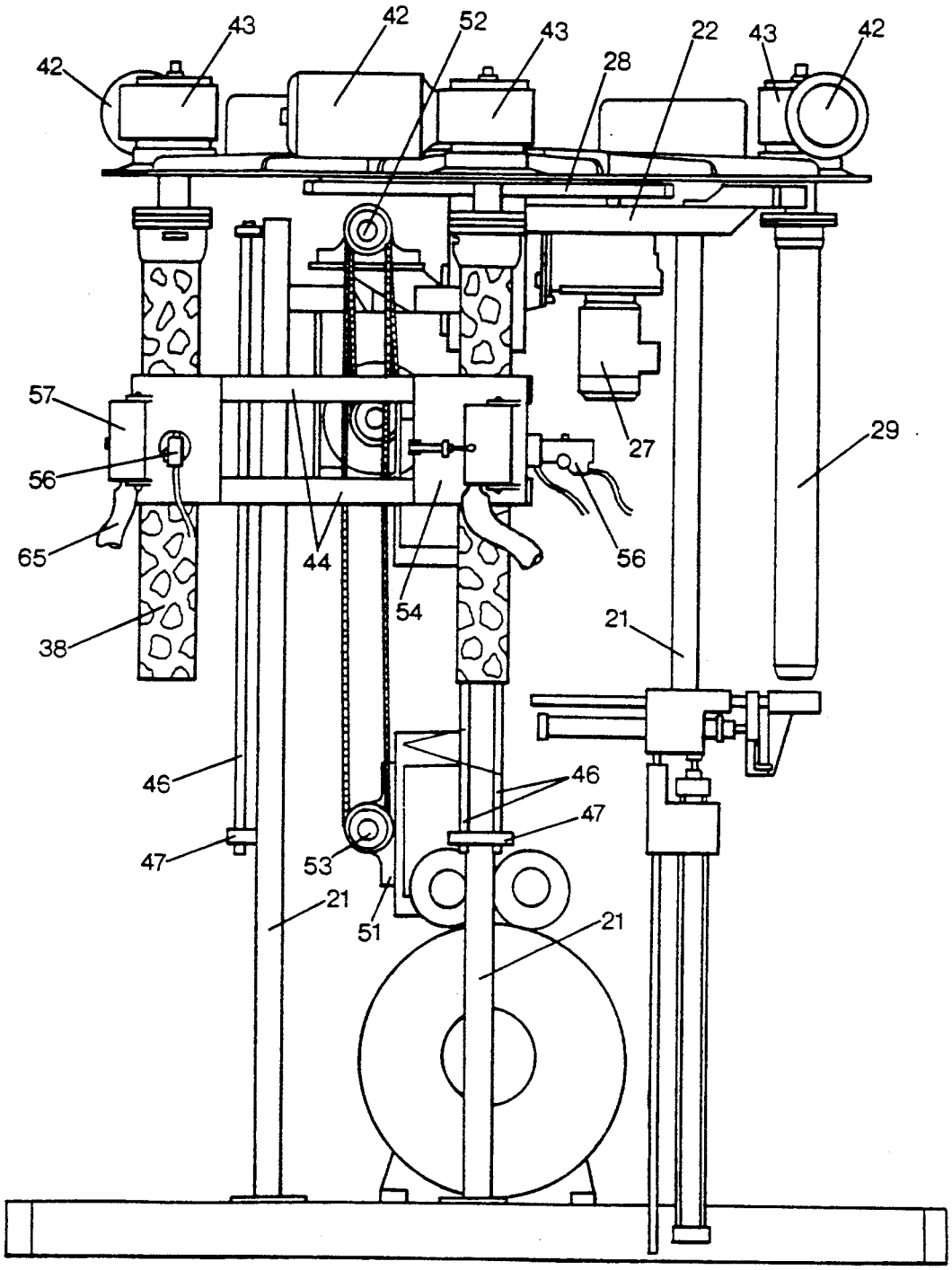
FIG. 4 shows the preferred form machine in side view similar to FIG. 3, during a printing operation.
Figure 6:
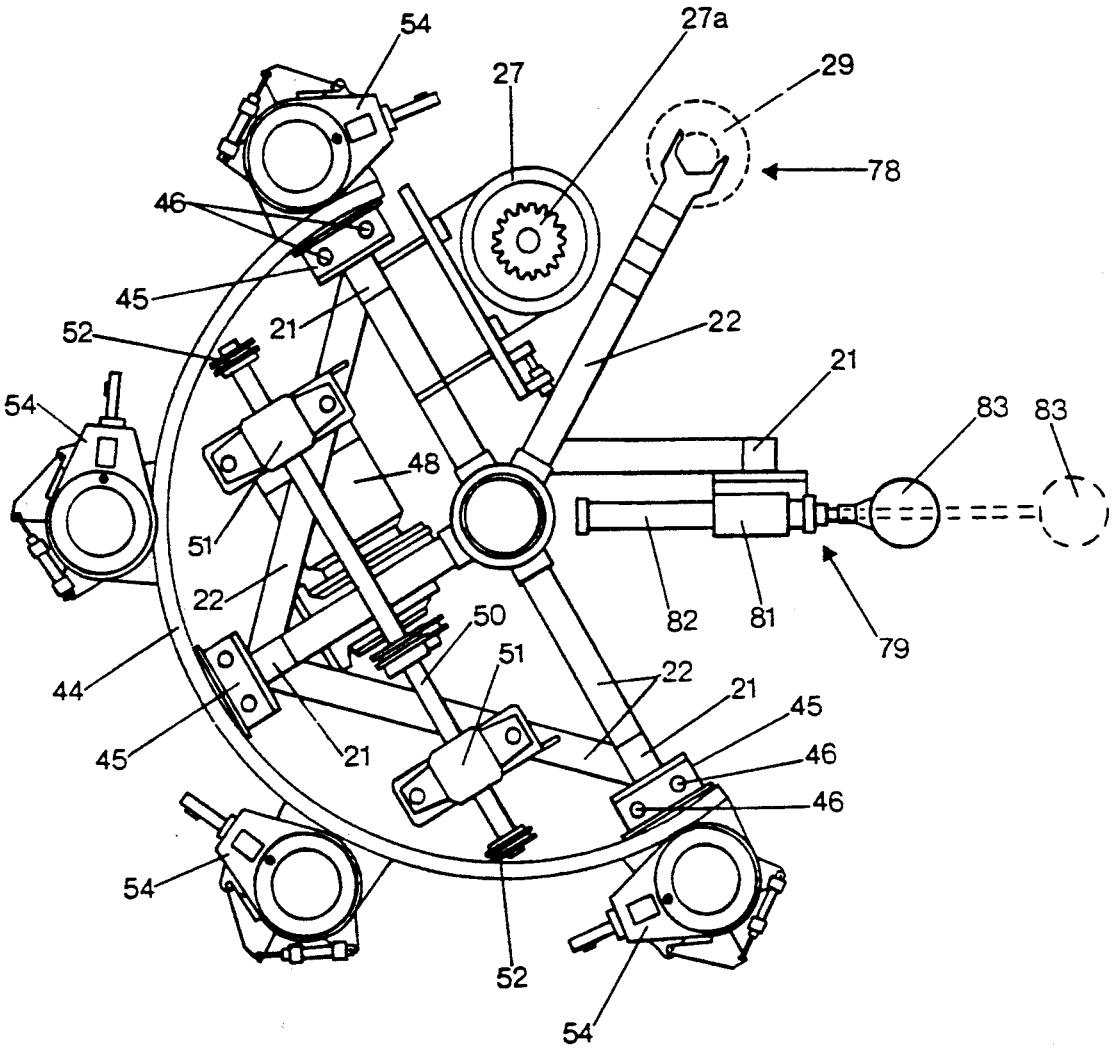
FIG. 6 shows the preferred form of the apparatus from above after removal of the rotating carousel thereof and parts carried thereby.

As well as the carousel 23, the base frame also carries a moving spray frame which in the preferred form apparatus shown in FIGS. 3 to 12 consists of two semi-circular members 44 one above the other, as shown in FIGS. 3, 4 and 6. The spray frame 44 carries three blocks 45 with two vertical apertures through each. Each of three uprights 21 of the base frame mounts two parallel guide rods 46 as shown in FIGS. 3 and 4. At their top and bottom ends each pair of guide rods 46 is mounted to the uprights 21 by bracket 47. The spray frame 44 can move vertically up and down on the three sets of guide rods 46, in the direction of arrow H in FIG. 3. In FIG. 3 the spray frame 44 is shown in its lowermost position, and in FIG. 4 the spray frame is shown part way up the guide rods 46.

To move the spray frame 44, a motor 48 is mounted to the base frame. Through chain 49 (see FIG. 3) the motor drives shaft 50 mounted across the top of the frame in bearings 51 as shown in FIGS. 3, 4 and 6. On its either end the shaft 50 carries sprockets 52. A similar shaft 53 extends across the base frame towards the bottom thereof (see FIG. 3). A chain extends around the sprockets 52 on the ends of the top and bottom shafts 50 and 53 on either side as shown in FIG. 3. The arrangement is such that driving of the spray frame drive motor 48 in one direction causes the spray frame 44 to move upwardly (on the guide rods 46) from the position shown in FIG. 3 towards the top of the apparatus as shown in FIG. 4, and reversing the motor 48 causes the spray frame 44 to move downwardly.

The spray frame 44 carries four spray and scavenging chambers 54. One spray and scavenging chamber is shown in side view in FIG. 9 and from above in FIG. 10. Each chamber 54 is in the preferred form apparatus generally keyhole shaped when viewed from above as in FIG. 10, but could be of any other suitable shape. The chambers 54 may be fabricated from sheet metal for example. Each chamber has a hollow interior with a cylindrical aperture 55 in the top wall and a similar aperture in the bottom wall and preferably a cylindrical liner extending between these apertures within the chamber, of a diameter slightly larger than the external diameter of the patterns 38. The diameter of these apertures is similar to the outside diameter of the patterns 38, so that the spray and scavenging chambers 54 can be moved by the moving spray frame 44 up and over the patterns 38 on the article supports 29, and can also receive the patterns 38 into the spray and scavenging chambers 54 so that they are suspended from the spray and scavenging chambers when the patterns are not in use, by the pattern ring 39 against the top wall of the spray and scavenging chambers. In FIG. 3 the patterns are shown suspended from the spray and scavenging chambers 54 while not in use.

A spray nozzle 56 is provided on one side of each spray and scavenging chamber 54 so that the spray nozzle 56 can direct a spray of dye or colouring agent on to a sock and pattern on an article support in the spray and scavenging chamber. In operation of the apparatus, the spray frame drive motor 48 is operated to raise the spray frame 44 and spray and scavenging chambers 54 carried thereby to its uppermost position. The article support drive motors 42 are operated to cause the article supports 29 and the socks and patterns over the socks to rotate within the spray and scavenging chambers 54. Dye is sprayed by the spray nozzles 56 into the spray and scavenging chambers and through the patterns 38 onto the socks below. The spray frame drive motor 48 is operated to move the spray frame 44 downwardly from its uppermost position while rotation of the article supports and spraying within the spray chambers continues, so that the socks are covered with spray of dye through the patterns 38, until the spray frame 44 reaches its lowermost position when the spray and scavenging chambers 54 have left the ends of the article supports and spray is stopped. In FIG. 4 the spray frame 44 carrying the spray and scavenging chambers 54 is shown part way down during spraying.

It is desirable to clean excess dye or coloring agent from each pattern after one spray pass over a sock, before the pattern is used with a subsequent sock. In the preferred form apparatus of FIGS. 3 to 12, vacuum heads 57 are provided to each spray and scavenging chamber 54. Each vacuum head 57 is pivotally mounted at 58 to the side of its respective spray and scavenging chamber 54, and has a hollow interior. Each vacuum head 57 has a soft scraper blade 59. Adjacent the edge of each scraper blade 59 is a longitudinal slot 60 forming a vacuum outlet for the vacuum head. Each vacuum head 57 can pivot between an operative position shown in hard outline in FIG. 10 where the part of the vacuum head carrying the scraper blade 59 and adjacent vacuum slot 60 projects into the interior of the spray and scavenging chamber 54 through opening 61 in the side of the chamber 54, and an inoperative position shown in dotted outline in FIG. 10.

Pivotal movement of each vacuum head 57 is controlled by a small pneumatic ram 62 mounted to the side of the spray and scavenging chamber 54 by bracket 63 at one end, and the shaft 64 of which is connected to the vacuum head 57. In use as the spray and scavenging chambers are carried down by the moving spray frame 44 over the rotating article supports, socks and patterns thereon, spraying coloring agent onto the socks through the patterns, the small ram 62 associated with each spraying chamber 54 is simultaneously operated to cause the vacuum head 57 to project into the spray and scavenging chamber so that the blade 59 thereof contacts and wipes over the exterior of the rotating pattern immediately above the spray head. The vacuum slot 60 is positioned forward of the blade 59 and takes up excess coloring agent on the blade 59. Thus in operation, coloring agent is sprayed onto the patterns, and the patterns are shortly thereafter wiped clean of excess dye by the blades 59 from which dye is removed through the vacuum slot 60 and exits the vacuum pipe 65 to waste or recycling (see FIG. 9). Over-spray within the spray and scavenging chamber 54 may be sucked through another vacuum port to the interior of the spray and scavenging chamber.

Instead of the arrangement of blade 59 and vacuum slot 60 the exterior of the pattern may be contacted by a series of flexible vacuum tubes preferably in two adjacent rows to form a bank of tubes which brush along the side of the rotating pattern during spraying to remove excess dye.

Scavenged coloring agent or dye, remaining on the pattern 38 after removal from the article support 29 and textile article, may be used in printing on a subsequent textile article.

Means is provided to automatically unload a sock from each article support 29 after completion of spraying with the desired number of colors or patterns, at an unloading station 78 indicated in FIG. 6. In operation of the apparatus each article support is stepped from a loading station 79 indicated in FIG. 6, where a sock is placed on the article support, through the four spray stations comprising the four spray and scavenging chambers 54, and to the unloading station 78 where the thus printed sock is removed. Referring back to FIGS. 7 and 8, within the interior of each article support 29 is provided a pneumatic cylinder 66 having a shaft 67. A head 68 is fitted to the end of the shaft 67. When the unload cylinder 66 is operated at the unload station 78, the shaft 67 moves out the end of the article support (see FIG. 7 and also FIG. 10), through a bore 69 in the bottom member 32 and end cap 34. As it does so it pushes the sock off the article support, which has previously been deflated prior to stopping to the unload station.

Any suitable arrangement to expand the article support may be provided. In the preferred form apparatus, to inflate the article supports 29 i.e. to cause the resilient covering 33 to expand to press a sock against the interior of the pattern 38 in use, a bore 70 passes down through the interior of the top member 31 of each article support. A rotating union 71 is provided at the top of the top member 31 of the article supports, which projects through the top of the gear box 43, and the rotating union 71 is connected to a pneumatic supply line. To expand the article support pressurized air is supplied over a supply line through the rotating union 71 and down the bore 70 to fill the interior of the article support 29. Holes 80 shown in FIG. 8 are provided through the side wall of the tube 30 forming the body of the article support i.e. the tube 30 is perforated, so that air under pressure enters behind the resilient covering 33 to inflate same. To return the article support to its normal size when a sock is to be removed, the air pressure is relaxed.

Figure 11:
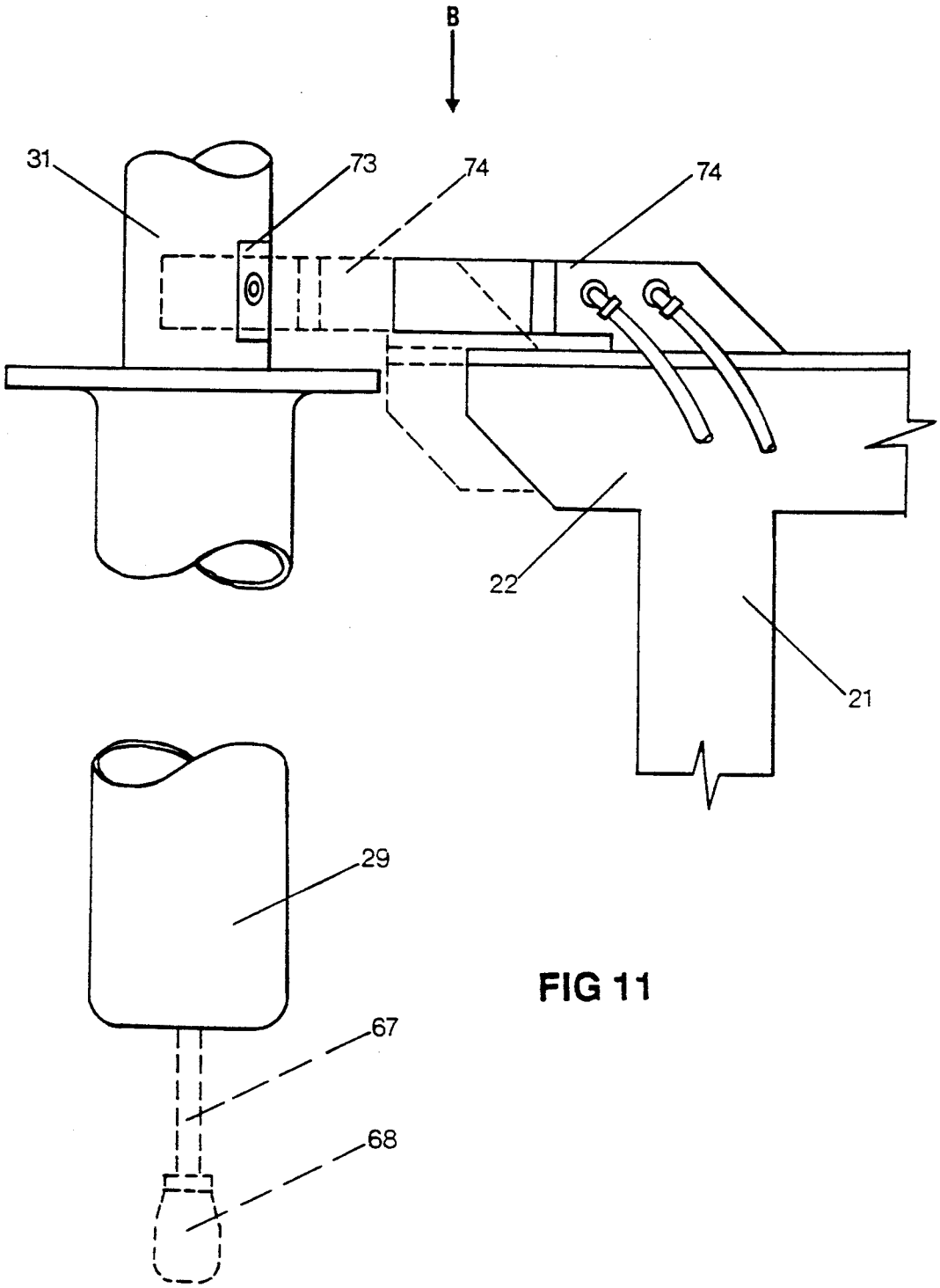
FIG. 11 shows the mechanism at the unloading station of the preferred form of the apparatus for supplying air to an article support at the unloading station to initiate unloading of a sock therefrom.
Figure 12:
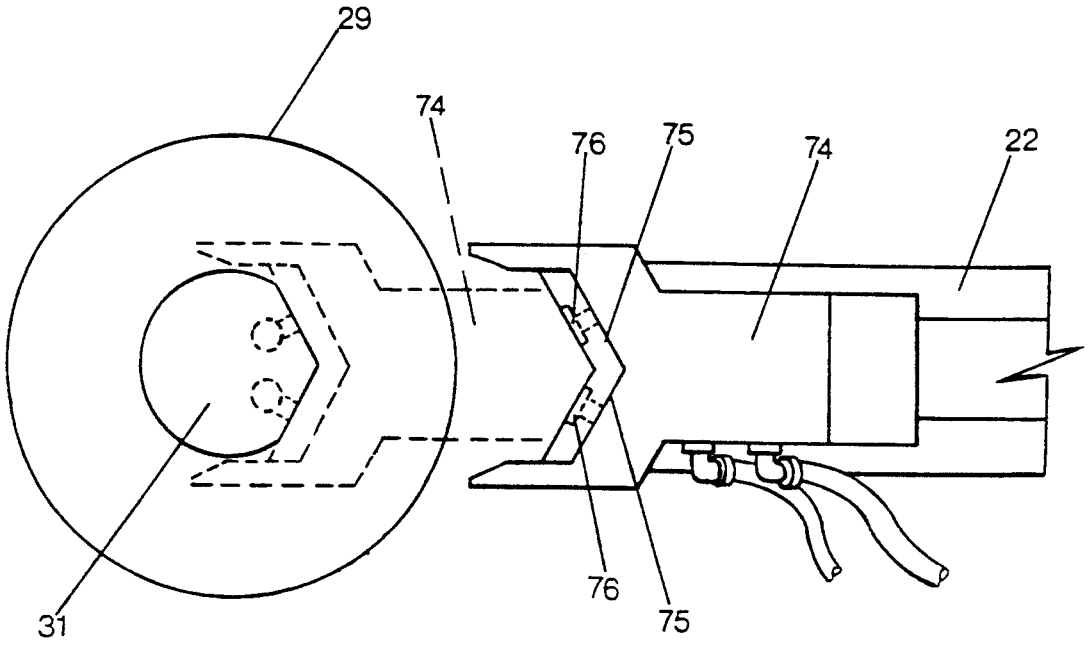
FIG. 12 shows similar components to FIG. 11 in the direction of arrow B in FIG. 11.

To extend and retract the shaft 67 of the unload cylinder 66, two bores 72 pass through the article support top member 31 to the unload cylinder. One such bore is shown in FIGS. 7 and 8 and the other is only partly visible. Each bore 72 exits the article support top member 31 at a flat 73 which is machined on the side thereof. Referring to FIGS. 11 and 12 where the flats 73 are clearly shown, at the unload station 78 an unload pneumatic supply arm 74 is slidably mounted on a cross-member 22 of the base frame. The unload pneumatic supply slide arm 74 may move between its retracted position shown in hard outline in FIGS. 11 and 12 and a forward position shown in phantom outline. The supply arm 74 is of a general Y configuration when viewed from above, having two faces 75 which match the flats 73 of the article support when the supply arm 74 is in its forward position, as shown particularly in FIG. 12.

In operation of the machine, when an article support is stopped at the unload station, its drive motor 42 indexes same so that it is in the correct position such that when the unload slide arm 74 moves from its retracted position to its forward position, the supply arm faces 75 will match with the article support flats 73. In so doing, pneumatic outlets 76 on the slide arm faces 75 contact the open ends of the bores 72 on the flats 73. When the slide arm 74 is in this forward position, compressed air is supplied over one of the supply lines 77 to the slide arm 74 to pass through the slide arm, through one bore 72, to cause the shaft 67 of the unload cylinder 66 to extend from the bottom of the article support. As the shaft 67 is extended the head 68 thereof will contact the inside of the toe of a sock on the article support and push the sock off the article support (the article support has previously been deflated at the unload station). Compressed air is then supplied over the other supply line 77 to cause the unload cylinder 66 to withdraw the shaft 67 back into the interior to the article support 29.

To load socks onto the article supports 29 at the loading station 79, before the socks are stepped through the four printing stations, sock loading means is provided as follows. An upright pneumatic cylinder 80 is carried by the base frame 20. The shaft of the cylinder 80 carries a frame 81. The frame 81 mounts a horizontally arranged pneumatic cylinder 82. The shaft of the cylinder 82 carries a bracket including the circular loading ring 83. The cylinder 80 may be operated to raise the bracket 81 and cylinder 82 and loading ring 83 to the full height of the top of the article supports 29, to the position indicated in broken lines in FIG. 3. The cylinder 82 may be operated to move the loading ring 83 outwardly to the position shown in broken lines in FIGS. 3 and 6. When the loading ring 83 is raised upwardly, it passes over an article support 21 at the loading station. To load a sock onto an article support 29 at the loading station, normally the loading ring 83 is in the position shown in broken lines in FIGS. 3 and 6. While in this position, a sock is placed through the loading ring 83 so that it hangs inside out downwardly from the loading ring, with the top of the sock over the loading ring. The loading ring 83 is then caused to move inwardly to the position shown in hard outline in FIGS. 3 and 6, for example under control of an operators foot pedal, prior to an article support 29 approaching the loading station. When the machine steps and an article support 29 approaches the loading station, the cylinder 80 operates to move the loading ring upwardly over the article support 29 at the loading station, to the position shown in broken lines in FIG. 3. As it does so, the loading ring will draw the sock carried thereby upwardly over the article support 29 in a rolling action. When the loading ring 83 returns downwardly the sock will remain on the article support.

Operation of the apparatus is as follows. The motor 27 causes the carousel 23 to move so that each article support is stepped from the loading station first to the printing station nearest the loading station, and then with each step to the subsequent printing stations, and finally to the unloading station. During operation the carousel steps continuously. At the unloading station, as each article support 29 having a sock thereon which has been printed approaches the unloading station it is in its unexpanded state. The article support is deflated prior to stepping from the last printing station, as will be described. Immediately after each article support 29 carrying a sock which has been printed arrives at the unloading station 78, the pneumatic supply unload arm 74 is caused, for example by solenoid or pneumatic control, to move to supply air to cause the unload cylinder 66 to operate to push the sock off the article support, the shaft of the unload cylinder then withdrawing, as described previously. The empty article support 29 is then moved in the next step of the carousel to the loading station. As each article support 29 approaches the loading station from the unloading station, a sock to be printed is loaded onto the article support, as described previously. That article support and the sock thereon are then stepped through the four printing stations and then after printing to the unload station.

After each step of the machine, printing is carried out simultaneously at each of the four printing stations. The sequence of printing operations is as follows. Immediately after one step of the machine the apparatus is in the position shown in FIG. 3. The four patterns 38 are suspended from the spraying and scavenging cylinders 54. The article supports 29 are deflated. First, the motor 48 drives the spray frame 44 upwards carrying the four patterns 38 over the article supports, one at each of the four printing stations. When the patterns 38 are fully over the article supports 29 and socks thereon as shown in FIG. 4 (one such pattern is shown fully home over the article support of FIG. 7) air is supplied to expand the four article supports i.e. air is passed to the interior of the article supports 29 to expand the resilient coverings 33 to press the socks on the article supports tightly against the interior of the patterns. Next, the motor 48 operates to carry the spray frame and spraying and scavenging chambers 54 downwardly to return them to the their lowermost position of FIG. 3. The patterns 38 remain on the article supports 29 however. As the spraying and scavenging chambers move downwardly, dye is sprayed from the spray nozzle 56 of each spraying and scavenging chamber over the pattern and sock on each article support. At the commencement of spraying the pneumatic ram 62 of each spraying and scavenging chamber is operated to move the vacuum head 57 of each spraying and scavenging chamber to the position shown in hard outline in FIG. 10, so that the blade 59 contacts the pattern to remove excess dye immediately after spraying as described previously. Also, the motors 42 for the article supports at the four spray stations are caused to operate to rotate the article supports and socks and patterns thereon during spraying. In FIG. 4 the spray frame 44 carrying the spraying and scavenging chambers 54 is shown partway down during spraying. When the spray frame 44 and spraying and scavenging chambers 54 have traversed downwardly over the entire length of the article supports 29 and socks and patterns thereon, spraying ceases. The patterns 38 remain on the article supports 29 because they are held thereon by the expansion of the article supports, and also to assist, by the pin 40 engaging into the top member 31 of each article support (see FIGS. 7 and 8). The motor 48 then reverses direction carrying the spray frame 44 and spraying and scavenging chambers 54 back up over the article supports until they again reach their topmost position. The article supports are then deflated so that the patterns 38 are again taken up by their respective spraying and scavenging chambers 54. The motor 48 is then reversed to carrying the spray frame 44 and spraying and scavenging chambers 54 and patterns 38 carried thereby downwardly to their lowermost position in FIG. 3. To ensure that no pattern is left on an article support 29, in the preferred form machine a flat pin 87 is slidably mounted under control of a small solenoid (not shown) in the top of each spraying and scavenging chamber 54. The flat pin 87 is caused to move inwardly to engage a slot formed in the top of each pattern ring 39, as shown in broken lines in FIG. 8. This ensures that when the spraying and scavenging chamber begins to move downwardly, it takes the pattern 38 with it. Once the spray frame 44 again reaches its lowermost position in FIG. 3, the carousel steps onwardly, carrying each article support 29 and the sock thereon but not the pattern, to the next printing station, or else in the case of the fourth printing station, to the unloading station.

Prior to removal at the unloading station the sock may, for example, pass through a hot air or steam blast to cure or partially cure the coloring agent on the sock. In an alternative embodiment steam used to inflate the article supports 29 could also warm the socks to fix the color, or small electric heating elements could be embedded beneath the surface of the supports.

Control of the stepped operation of the machine through the motor 27, of the motor 48 driving the spray frame 44, and of the motors 42 driving rotation of the article supports 29, and of the pneumatic systems for inflating the article supports 29 and operating the unload cylinders 66 etc may be by way of a suitable microprocessor control system. Such a such also controls the spray heads 56, the solenoid 62 controlling the vacuum heads 57, and other functional aspects of the apparatus.

DESCRIPTION OF THE SECOND PREFERRED EMBODIMENT PER FIG. 13

Figure 13:
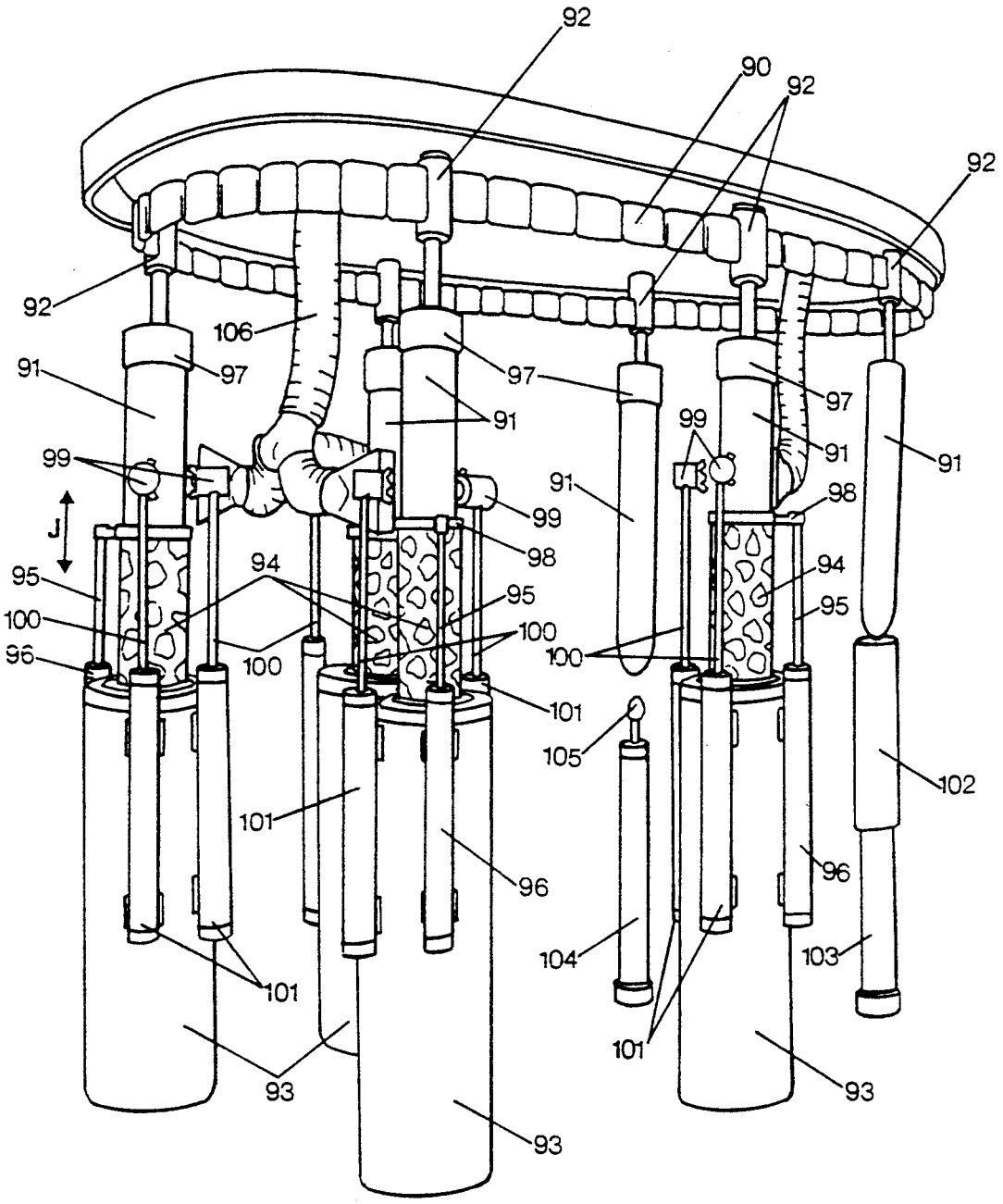
FIG. 13 shows a second preferred form of the apparatus of the invention.

FIG. 13 shows another preferred form of apparatus of the invention which comprises a chain or similar conveyor system 90 as the apparatus conveyor means, instead of a rotating carousel as in FIGS. 3 to 12. The conveyor 90 carries article supports 91 through junctions 92.

The article supports 91 are of a similar structure to those of the apparatus of FIGS. 3 to 12, comprising a cover of a resilient material such as rubber or a similar synthetic material over an internal frame. Each of the supports 91 is expandable by inflation from within over a pneumatic control line (not shown).

In this preferred form the apparatus comprises a number of scavenging chambers 93 below the article supports 91, one at each of four printing stations. Each scavenging chamber 93 is a generally upright cylinder in shape open at the top. Four patterns 94 are each a sliding fit one in each scavenging chamber 93, so that each pattern 94 may move in and out of its scavenging chamber 93 during operation of the machine, in the direction of arrow O in FIG. 13. Each pattern 94 is carried by an upright arm 95 which forms the rod of a pneumatic or hydraulic cylinder 96. The arrangement is such that at each printing station the cylinder 96 may be caused to raise the pattern 94 out of or lower the pattern into its respective scavenging chamber 93. In FIG. 13 the patterns 94 are shown partly out of the scavenging chambers 93.

In operation of the machine, when positioned over a scavenging chamber 93 one of the article supports 91 is aligned therewith. The cylinder 96 is operated to raise its pattern over the article support 91 above and the sock carried thereby, entering the article support and sock into the pattern. The article support 91 is then caused to expand to press the sock tightly against the interior of the pattern 94. The pattern may rotate with the support under control of the drive of the motors 97. Each pattern 94 is rotatably carried by its arm 95 in a circular bearing arrangement 98, so that at each printing station as the article support 91 rotates the pattern 94 rotates with it.

Spray heads 99 are provided at each printing station. In the preferred form apparatus shown, each printing station has three spray heads and each spray head 99 is carried by an upright arm 100 which in turn forms the shaft of a pneumatic or hydraulic cylinder 101. The cylinders 101 may be operated to raise and lower the spray heads as the support/article/pattern are rotated, to spray the dye through the pattern onto the article. Vacuum ducts 106 remove overspray. In an alternative arrangement one or more rollers or sets of dye applying bristles contacting the patterns 94 could be used instead of spray heads for example.

The loading station comprises a loading cylinder 102 of slightly larger diameter than the article supports 91 before expansion, which is in turn carried by a pneumatic or hydraulic ram 103. The ram 103 may be operated to raise and lower the loading cylinder 102 as indicated by arrow K in FIG. 12. In use, a sock is placed inside out over the loading cylinder 102 with the toe of the sock at the top of the loading cylinder and the body of the sock over the exterior of the loading cylinder. After each step of the machine an article support 91 carrying a sock which has passed through all of the printing stations approaches unloading station 104 before the loading station. The article support 91 is unexpanded and the printed sock is removed therefrom. The sock may be removed at the unloading station by hand or by a device 105 which clamps the toe of the sock and pulls it off, or by an internal arm within each article support which pushes the sock off as in the apparatus of FIGS. 3 to 12.

The machine then proceeds to perform a further step. At the loading station, at each step of the machine the ram 103 operates to push the loading cylinder 102 with a sock thereon upwards and over a support 91 above from which a printed sock has just been removed at the unloading station, as it does so pushing the sock on the loading cylinder right side out over the support. The ram 103 then withdraws the loading cylinder 102 and the machine steps on, following which an operator may place a further sock onto the loading cylinder and so forth. As the machine steps, each newly loaded sock is passed through each of the four printing stations where it is subjected to printing operations.

In either the apparatus of FIGS. 3 to 12, or of FIG. 13, each printing station may apply a color and/or pattern different to that applied at the other three printing stations to produce a multi-colored and/or multi-patterned garment. Instead of four printing stations an apparatus of the invention may have more than four printing stations to print socks with more than four colors and/or patterns, or less than four printing stations. A single color or single pattern machine would require a minimum of only one printing station. Any arrangement of one or more printing stations with any required number of loading and unloading stations is possible.

As indicated previously, the dye or coloring agent may be applied by roller instead of spraying. A roller for example formed of sponge or the like, may contact the exterior surface of the pattern on an article support carrying a textile article as shown. The roller rotates with the article support and the roller is sufficiently spongy that the roller material will contact the textile article on the article support through the apertures in the pattern to apply the color agent or dye. Vacuum ducts may be provided to remove dye spun from the roller as it rotates at speed during operation.

The patterns may be in the form of rigid perforated cylinders, formed of metal such as stainless steel for example. Alternatively the pattern cylinders could be formed of perforated plastic material. The patterns need not necessarily be rigid, but could comprise cylinders of plastic mesh for example. The article supports may be expanded pneumatically or by steam as referred to, or mechanically, or by any other means, and may be oval as well as cylindrical as described.

It will be appreciated that the invention provides an improved apparatus and process for coloring textile articles and particularly garments such as socks or items of hosiery. The invention is not limited to the printing or coloring of socks or items of hosiery however. To print trousers or pants for example, each trouser leg could be printed on the apparatus of the invention individually before being joined together to form a pair of trousers. Alternatively an inverted Y-shaped support could carry a complete pair of trousers inserting each leg into a separate pattern and scavenging chamber at each printing station. For articles of more complex shape, such as sweaters, a support in the shape of the sweater, with a complementary pattern, could be used. Alternatively, if only the body and sleeves of the sweater are to be patterned, cylindrical supports and patterns of appropriate sizes, may be used. Flat sections of material may be printed by being wrapped around the article supports which could be horizontally oriented.

The foregoing describes the invention generally and by way of example to preferred embodiments. Alterations and modifications as will be apparent to those skilled in the art are intended to be incorporated within the scope hereof as defined in the claims.

We claim:

1. A process for applying a pattern to form a design in a contrasting color on a woven or knitted textile article, comprising:

entering the textile article onto an article support bringing a pattern provided with one or more apertures defining the design in an overlying relationship about the article on the support, causing the article support to expand to press the textile article tightly against an interior of the pattern, applying a coloring agent to the article through the pattern, and subsequently contracting the article support and removing the patten and article with the design formed thereon.

2. A process as claimed in claim 1, wherein:

the article support is caused to expand sufficiently to stretch open the weave or knit of the textile article in pressing the article against the pattern.

3. A process as claimed in claim 1, wherein:

the textile article is a tubular article or a tubular part of a textile article.

4. A process as claimed in claim 3, wherein:

the textile article is an item of hosiery.

5. Apparatus for patterning a textile article by forming a design thereon, comprising:

an article support of a shape whereby a textile article to be printed may be entered over the support;

a pattern;

means for bringing the pattern into an overlying relationship about the article on the support;

means for causing the support to expand to press the article tightly against the pattern within the pattern; and means for applying a coloring agent to the article through the pattern.

6. Apparatus as claimed in claim 5, wherein:

the pattern is generally cylindrical and the article support is a generally cylindrical support expandable to press the textile article against the interior of the cylindrical pattern.

7. Apparatus as claimed in claim 6, wherein:

the exterior of the article support is composed of a resiliently expandable rubber or synthetic material.

8. Apparatus as claimed in claim 7, wherein:

the article support comprises means for causing the article support to expand and for pressing the sides of the article support outwardly.

9. Apparatus for applying a pattern in contrasting color to textile articles, comprising:

conveyor means carrying a multiple number of generally cylindrical article supports of a shape complementary to the shape of the textile articles for each receiving a textile article over the article supports:

a plurality of printing stations, each comprising a generally cylindrical pattern and means for applying a coloring agent onto a textile article through the pattern, with the conveyor means arranged to move the article supports to and from the printing stations;

means for movably mounting one of the pattern and the article support for movement thereof relative to one another, to enter the article support and a textile article thereon into the pattern for printing and to remove the article support and textile article from the pattern after printing; and means to cause each article support to expand when at one of said printing stations to press the article against the pattern sufficiently to hold the pattern over the textile article during printing.

10. Apparatus as claimed in claim 9, wherein:

at each printing station the pattern is movably mounted for entering the article support and textile article thereon into the pattern by moving the pattern over the article support for printing and for removing the pattern from the article support after printing, and wherein each printing station comprises scavenging means to scavenge coloring agent remaining on the pattern after removal from the article support and textile article, for use of said scavenged coloring agent in printing of a subsequent textile article.

11. Apparatus as claimed in claim 10, wherein:

at each printing station the pattern is rotatably mounted, and wherein the apparatus comprises motor means for rotating the article support and textile article and pattern held thereon relative to spray means for applying said coloring agent by spraying thereof onto the textile article.

12. Apparatus for applying a multicolor contrasting pattern to generally textile articles, comprising:

a series of printing stations;

conveyor means carrying sequentially to one and then another of the printing stations plurality of generally cylindrical article supports of a shape complementary to the shape of the textile articles for each receiving a textile article over the support;

at each printing station a generally tubular pattern;

means movably mounting one of the pattern and the article support for movement thereof relative to one another to enter the article support and a textile article thereon into the pattern and to remove the article support and textile article from the pattern after printing; and at each said printing station, means for applying to a textile article on a corresponding article support, through said pattern a coloring agent of a color contrasting to a coloring agent applied at another of the printing stations.

13. Apparatus as claimed in claim 12, wherein:

the article supports are carried from above by the conveyor means and the apparatus comprises means for movement of the pattern at each printing station below said conveyor upwardly over an article support to enter the pattern onto the article support for printing and removal.

14. Apparatus as claimed in claim 12, wherein:

the apparatus also comprises means for rotational movement of at least one a) the article support and textile article and pattern carried thereon and b) the means to apply coloring agent to the textile article through the pattern relative to the other at each printing station during application of the coloring agent.

15. Apparatus as claimed in claim 13, wherein:

the conveyor means rotatably mounts the article supports for rotation of the article supports relative to spray means for applying coloring agent by spraying thereof onto the textile article at each printing station.

* * * * *

UNITED STATES PATENT AND TRADEMARK OFFICE

CERTIFICATE OF CORRECTION

PATENT NO. :5,288,322

DATED :February 22, 1994

INVENTOR(S) :Ashley R. Hanna et al.

It is certified that error appears in the above-indentified patent and that said Letters Patent is hereby corrected as shown below:

On the title page, please delete item [73] and insert the following therefor:

--[73] Assignee: Hanna Technology Ltd., Christchurch, New Zealand--

Signed and Sealed this

Fifteenth Day of November, 1994

*Attest:*

Bruce Lehman

BRUCE LEHMAN

*Attesting Officer*

*Commissioner of Patents and Trademarks*